United States Patent [19]

Wells

[11] 3,995,554

[45] Dec. 7, 1976

[54] PROCESS FOR PREPARING RESILIENT BLOWN IMAGED PRINTING MASTERS

[75] Inventor: John B. Wells, Savannah, N.Y.

[73] Assignee: Xerox Corporation, Stamford, Conn.

[22] Filed: June 3, 1974

[21] Appl. No.: 475,369

[52] U.S. Cl. ..... 101/401.1; 101/395; 101/426; 101/467; 427/373; 427/387

[51] Int. Cl.[2] ..... B41C 3/06

[58] Field of Search ..... 101/128.2–128.4, 101/455, 463, 466, 467, 470, 471, 395, 401.1, 426; 156/4, 5; 117/6, 35.5, 38, 62.1, 161 ZA, 132 BS; 9.6/35, 36, 36.2–36.4

[56] References Cited

UNITED STATES PATENTS

| | | | |
|---|---|---|---|
| 2,979,246 | 4/1961 | Liebeskind | 229/14 |
| 3,391,637 | 7/1968 | Reynolds et al. | 101/401.3 |
| 3,399,106 | 8/1968 | Palmer et al. | 161/119 |
| 3,408,218 | 10/1968 | Van Muylwijk | 117/38 X |
| 3,440,076 | 4/1969 | Vaurio | 117/38 X |
| 3,510,340 | 5/1970 | Blake et al. | 427/288 |
| 3,615,972 | 10/1971 | Morehouse et al. | 117/6 X |
| 3,677,178 | 7/1972 | Gipe | 101/460 |
| 3,734,768 | 5/1973 | Smith | 117/161 ZA |
| 3,817,178 | 6/1974 | Hagen | 101/379 |

OTHER PUBLICATIONS

NCR Factory News, Oct. 1959, "NCR Capsules Have Wide Possibilities".

*Primary Examiner*—Clyde I. Coughenour
*Attorney, Agent, or Firm*—James J. Ralabate; James P. O'Sullivan; Donald M. MacKay

[57] ABSTRACT

A process for preparing a resilient foamed imaged printing master is provided. The process comprises depositing a conversion imaging fluid in image configuration on a printing master, said conversion fluid comprising an expandable polymer containing an encapsulated blowing agent and activating said blowing agent to expand said polymer and form a resilient foamed developed image.

12 Claims, 4 Drawing Figures

PROCESS FOR PREPARING RESILIENT BLOWN IMAGED PRINTING MASTERS

BACKGROUND OF THE INVENTION

In conventional offset lithography an imaged master is inked and the inked image transferred to an offset (blanket) roller from which the actual printing takes place. In direct lithography the inked image is transferred directly to the receiver sheet. Offset lithography is much more important as a commercial process and one of the principal reasons for this is that it is difficult to form resilient images on a master so that high quality prints can be obtained by direct printing. It is to this problem to which this invention is directed.

BRIEF DESCRIPTION OF THE INVENTION

It has now been discovered that prints of excellent quality can be obtained in the direct mode if a resilient image is formed on the printing master. Thus the resilient image provides the same resiliency provided by the offset blanket roller in offset printing. Further it has been discovered that the resilient image can be formed to a relief suitable for producing high quality prints employing conventional imaging methods and master materials. More particularly, the resilient image is formed on a printing master by depositing a conversion imaging fluid in image configuration, said fluid comprising an expandable polymer containing an encapsulated blowing agent and activating said blowing to expand said polymer to the desired relief to form the resilient image. In a preferred embodiment, the conversion imaging fluid contains an ink so that the fluid can be applied to an already imaged and inked master which is aided by the affinity of the two inks. Consequently, either a conventional printing master having fountain solution in its non-imaged areas can be employed or a waterless lithographic master having non-imaged areas formed of an abhesive layer such as a silicone elastomer can be employed. After the imaging fluid is applied to the master, the blowing agent contained in the expandable polymer is activated such as by heat to obtain the desired relief and then the master is ready for use on a printing press employing conventional inks and equipment.

DETAILED DESCRIPTION OF THE INVENTION

Figure 1:
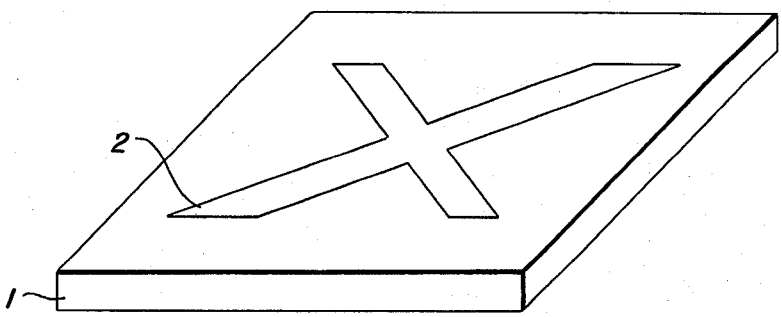
FIG. 1 depicts the imaged printing master of the invention.
Figure 2:
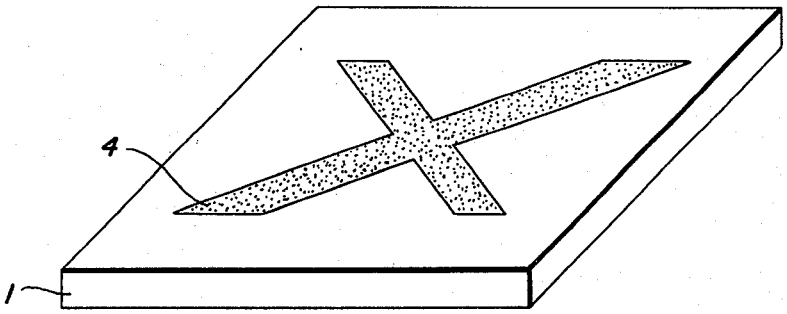
FIG. 2 depicts the imaged printing master with conversion imaging fluid in image configuration, said fluid comprising an expandable polymer containing an encapsulated blowing agent.
Figure 3:
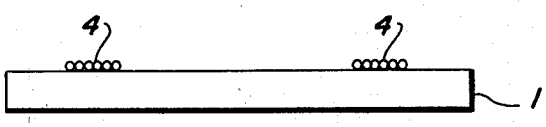
FIGS. 3 and 4 depict the imaged printing master with a resilient image formed by activation of the blowing agent to expand the expandable polymer.
Figure 4:
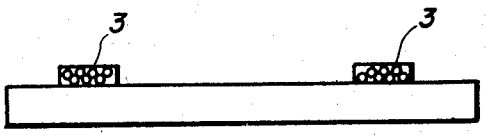

Referring now to the drawings and specifically FIG. 1, the printing master comprises a suitable substrate 1 which is a self-supported material such as metal, plastic or the like and 2 is an image. A conversion imaging fluid is deposited in image configuration which is depicted in FIGS. 2 and 3 by numeral 4. The conversion imaging fluid contains an expandable polymer containing an encapsulated blowing agent. In FIG. 4 a resilient image is shown as 3 resulting from the activating of the blowing agent to expand the polymer in the conversion imaging fluid.

The imaging and master materials, methods of imaging and other aspects of the invention will now be discussed in detail.

Expandable polymers which can be employed in the conversion imaging fluid include a number of thermoplastic monomer particles having encapsulated therein at least one volatile raising or blowing agent which exerts little solvent action on the resulting polymer and which is present in a quantity in excess of that which is soluble in the polymer. A wide variety of organic materials may be employed as the monomer particles. Typical of these are the alkenyl aromatic monomers. By the term "alkenyl aromatic monomers" is meant a compound having the general formula:

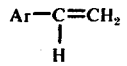

wherein Ar represents an aromatic hydrocarbon radical or an aromatic halohydrocarbon radical of the benzene series. Examples of such alkenyl aromatic monomers are styrene, o-methylstyrene, m-methylstyrene, p-methylstyrene and ethylstyrene. Various other styrene derived compounds may be employed such as vinylbenzyl chloride, p-tert-butylstyrene, and the like.

The acrylate monomers alone or in combination with the alkenyl aromatic monomers may also be utilized. Such acrylatetype monomers include monomers of the formula:

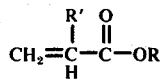

wherein R is selected from the group consisting of hydrogen and an alkyl radical containing from about one to 12 carbon atoms and R′ is selected from the group consisting of hydrogen and methyl. Typical acrylate materials which may be used are methyl methacrylate, ethyl acrylate, propyl acrylate, butyl acrylate, butyl methacrylate, propyl methacrylate, butyl methacrylate, lauryl acrylate, 2-ethylhexylacrylate, ethyl methacrylate, and the like.

Copolymers of vinyl chloride and vinylidene chloride, acrylonitrile with vinyl chloride, vinyl bromide, and similar halogenated vinyl compounds may be incorporated in compositions in accordance with the invention. Esters, such as the vinyl esters having the formula:

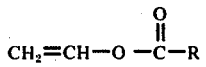

wherein R is an alkyl radical containing from one to 17 carbon atoms, may also frequently be employed with benefit. Typical monomers falling within this classification are vinyl acetate, vinyl butyrate, vinyl stearate, vinyl laurate, vinyl myristate, vinyl propionate, and the like.

A wide variety of blowing or raising agents may be incorporated within the polymerization system. They can be volatile fluid-forming agents such as aliphatic hydrocarbons including ethane, ethylene, propane, propene, butene, isobutene, neopentane, acetylene, hexane, heptane, or mixtures of one or more such aliphatic hydrocarbons having a molecular weight of at least 26 and a boiling point below the range of the softening point of the resinous material when saturated with the particular blowing agent utilized.

Typical resinous materials, blowing agents and a method for preparing the expandable polymers are disclosed in U.S. Pat. No. 3,615,972, which is herein incorporated by reference in its entirety.

The conventional masters can be employed. Typical masters include cellulose or other colloid coated on a suitable self-supporting substrate such as paper, a metal such as aluminum or plastic such as polyester, polycarbonate, polysulfone or nylon. Alternatively, a master having a silicone elastomeric surface layer is employed so that printing can be accomplished without the need for a fountain or dampening solution.

The silicone gums which can be employed to coat the substrate are the conventional types employed heretofore in waterless lithography, which have reactive crosslinking sites or are capable of being cured to an ink releasable elastomeric condition. Exemplary of suitable silicone gums are those having only methyl containing groups in the polymer chain such as polydimethylsiloxane; gums having both methyl and phenyl containing groups in the polymer chain as well as gums having both methyl and vinyl groups, methyl and fluorine groups, or methyl, phenyl and vinyl groups in the polymer chain.

Typical silicone gums which are of the heat curing or thermally curable type suitable for use in the invention are Syl Gard No. 182, Syl Off No. 22 and No. 23 manufactured by Dow Corning, Midland, Michigan; Y-3557 and Y-3602 silicone gum available from Union Carbide Company, New York, N.Y., as well as No. 4413 silicone and No. 4427 heat curable silicone gums available from General Electric Company, Waterford, N.Y. The Y-3557 and Y-3602 gums specifically have aminoalkane crosslinking sites in the polymer backbone which react with a diisocyanate crosslinking agent over a wide range of temperature and time to produce a durable, ink releasable elastomeric film.

The master can be imaged by conventional techniques such as by photoresists, electrophotography, electrostatic printing, photoelectrophoresis and electrographic imaging. A particulate image can be developed on a separate photoconductive surface and transferred to the master or a photosensitive material such as cadmium sulfoselenide, zinc oxide or the like can be incorporated into the master so as to permit imaging and development on the printing master. By employing a conversion imaging fluid containing an ink, and imaging the master with a particulate imaging material which is compatible with the ink, the conversion imaging fluid can be conveniently applied to only the imaged areas. For example, if a conventional water based lithographic master is employed the master can be imaged with a hydrophobic thermoplastic material such as polyethylene or polystyrene, the imaging material fused by heat and then water fountain solution applied to the non-imaged areas. A conversion imaging fluid comprising a hydrophobic ink can then be selectively applied to the master, the blowing agent activated to expand and form the resilient image, and the master is ready for printing. When a waterless lithographic master is employed having non-imaged areas formed of an ink releasing material such as a silicone elastomer, an imaging fluid is employed which will not adhere to the abhesive background areas.

After the imaging fluid is applied to the master in image configuration, the blowing agent can be activated such as by heat to expand the polymer particles to the desired relief. The polymers can be expanded to a relief of between about 25 and 100 microns although a preferred range is between about 25 and 50 microns. The amount of relief can be controlled by either controlling the quantity of expandable polymer employed and/or the time and temperature of the heating step. Thus the polymer particles which commonly have diameters of between about 5 and about 10 microns, can be applied in a quantity to provide either single or multiple layers and the relief can be further controlled by the amount of heat applied to the image.

The master can then be mounted on a conventional printing press and prints made therefrom employing conventional inks. Typical inks include inks of the rubber or oleophilic type having the vehicle component for the ink pigments derived from various oleophilic materials such as aromatic and aliphatic hydrocarbons, drying oil varnishes, lacquers, and solvent type resins.

The following examples will serve to illustrate the invention. All parts and percentages in said examples and elsewhere in the specification and claims are by weight unless otherwise specified.

EXAMPLE I

A commercial waterless lithographic printing master (3M Driographic Master) comprising a silicone elastomer surface on an aluminum substrate was imaged by the procedure of Curtin (U.S. Pat. No. 3,511,178—Eg. I) and was then Brayer roll coated with a conversion fluid to a wet film thickness of about 5 microns. The conversion imaging fluid which adhered to only the lithographic imaged areas was made by dispersing 0.5 gram of expandable polymer (Dow Chemical Company XP-4520/02 Saran microspheres of a diameter from 6 to 8 microns containing encapsulated isobutane) with 2.0 grams of Van Son PMS rubber based ink. The plate was then heated for 15 seconds at 90° C in an air oven to expand the microspheres to a diameter of about 35 microns and dry the ink to form an ink receptive resilient imaged area about 35 microns thick. The converted plate was then Brayer roll inked with an oil base printing ink (Pope and Gray BOG-2441) and the image transferred to a sheet of bond paper by placing the plate in contact therewith and rolling a hand held roller over the plate with light contact pressure. The printing step was repeated a dozen times and the prints were all of excellent quality.

EXAMPLE II

A diazo-type printing master (Eastman Kodak Diazo Litho Plate D) is imagewise exposed employing a pulsed Xenon lamp in a vacuum frame and the surface layer of the non-imaged and non-exposed areas removed by washing with Kodak One-Step Desensitizer-Lacquer D to provide a relief image of about 0.5 micron. Fountain solution (A. B. Dick lithographic solution) is applied to the master with a cotton pad. After the background areas were thoroughly wet, the conversion imaging fluid of Example I was applied to the imaged areas of the plate and the microspheres expanded in accordance with the procedure of Example I. The plate was then run on a Davidson Press in the direct printing mode and a total of 250 excellent copies obtained on bond paper employing Van Son 10850 rubber based ink. No observable wear was noted on the printing plate.

EXAMPLE III

The general procedure of Example 1 is repeated but for the exception that a latent electrostatic test image is formed and cascade developed with Xerox 3600 dry toner on a photosensitive zinc oxide coated paper printing master (Bruning 2000). The toner image is vapor fused by placing the master in a Xerox vapor fuser for 7 seconds employing trichloroethylene. The imaged printing master is then etched with A. B. Dick offset electrostatic conversion solution 4-1050, and the conversion imaging fluid of Example 1 applied and expanded thereon. When the master is inked and the image transferred, excellent prints are obtained.

EXAMPLE IV

The general procedure of Example III is repeated, but for the exception that the toner image is transferred to an offset non-sensitized paper master (A. B. Dick 3000 series) and the non-imaged areas wetted with a fountain solution (A. B. Dick Offset Fountain Solution 4-1114). Excellent prints are again obtained.

Having described the present invention with reference to these specific embodiments, it is to be understood that numerous variations may be made without departing from the spirit of the present invention and it is intended to encompass such reasonable variations or equivalents within its scope.

What is claimed is:

1. A method of forming a resilient image on a printing master comprising, providing a developed imaged printing master, providing a conversion imaging fluid comprising an expandable polymer containing an encapsulated blowing agent, depositing said conversion imaging fluid on the image of said imaged printing master, and activating said blowing agent to expand said polymer and form a resilient relief image.

2. The method of claim 1 wherein the imaging fluid deposited on the printing master is expanded by activation of the blowing agent to a relief of between about 25 and about 50 microns to form the resilient image.

3. The method of claim 1 wherein the expandable polymer comprises an alkenyl aromatic monomer.

4. The method of claim 1 wherein the expandable polymer comprises a copolymer of vinylidene chloride and acrylonitrile.

5. The method of claim 1 wherein the blowing agent is isobutane.

6. The method of claim 1 wherein the resilient image is formed on an abhesive silicone master.

7. A method of forming a resilient image on a printing master comprising, providing a developed an imaged printing master having ink on its imaged areas, providing a conversion imaging fluid comprising an expandable polymer containing an encapsulated blowing agent and an ink compatible with the ink on said imaged areas, depositing said conversion imaging fluid on the image of said imaged printing master and activating said blowing agent to expand said polymer and form a resilient relief image.

8. The method of claim 7 wherein the imaging fluid deposited on the printing master is expanded by activation of the blowing agent to a relief of between about 25 and about 50 microns to form the resilient image.

9. The method of claim 7, wherein the expandable polymer comprises an alkanyl aromatic monomer.

10. The method of claim 7 wherein the expandable polymer comprises a copolymer of vinylidene chloride and acrylonitrile.

11. The method of claim 7 wherein the blowing agent is isobutane.

12. The method of claim 7 wherein the resilient image is formed on an abhesive silicone master.

* * * * *

UNITED STATES PATENT AND TRADEMARK OFFICE

CERTIFICATE OF CORRECTION

PATENT NO. : 3,995,554

DATED : December 7, 1976

INVENTOR(S) : John B. Wells

It is certified that error appears in the above-identified patent and that said Letters Patent are hereby corrected as shown below:

Column 1, line 30 after "blowing" insert the word --agent--.

Column 6, line 29 in Claim 9 "alkanyl" should read --alkenyl--.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*